US006183209B1

(12) United States Patent
Allen

(10) Patent No.: US 6,183,209 B1
(45) **Date of Patent: *Feb. 6, 2001**

(54) AUXILIARY PUMP MEANS OF AN ADVANCE ARRANGEMENT OF A HIGH PRESSURE PISTON PUMP

(75) Inventor: Peter David Allen, Ashford (GB)

(73) Assignee: Lucas Industries Limited (GB)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/009,669

(22) Filed: Jan. 20, 1998

(30) Foreign Application Priority Data

Feb. 14, 1997 (GB) ..... 9703121

(51) Int. Cl.[7] ..... F04B 49/00
(52) U.S. Cl. ..... 417/218; 417/199.1; 123/502
(58) Field of Search ..... 417/218, 42, 199.1, 417/221; 123/502

(56) References Cited

U.S. PATENT DOCUMENTS

| | | | | |
|---|---|---|---|---|
| 4,393,846 | | 7/1983 | Mowbray et al. | 123/502 |
| 4,407,250 | * | 10/1983 | Eheim et al. | 123/502 |
| 4,733,640 | | 3/1988 | Laufer et al. . | |
| 4,743,179 | * | 5/1988 | Waas et al. | 417/417 |
| 5,059,096 | * | 10/1991 | Harris | 417/221 |

FOREIGN PATENT DOCUMENTS

| | | | | |
|---|---|---|---|---|
| 1932600 | | 1/1971 | (DE) . | |
| 3516456A1 | | 11/1986 | (DE) . | |
| 58-59319 | * | 4/1983 | (JP) | 123/502 |
| 58-59320 | * | 4/1983 | (JP) | 123/502 |

* cited by examiner

*Primary Examiner*—Timothy S. Thorpe
*Assistant Examiner*—Cheryl J. Tyler
(74) *Attorney, Agent, or Firm*—Michael Best & Friedrich LLP

(57) ABSTRACT

An advance arrangement is described including an advance piston slidable within a bore and defining, with the bore, a control chamber. A restricted passage permits fluid to escape from the control chamber at a controlled rate. A pump supplies fluid to the control chamber, the rate at which fluid is supplied to the control chamber relative to that at which the fluid can escape controlling the position of the advance piston. The pump is independent of a feed pump used to supply fuel to the high pressure pump with which the advance arrangement is used.

6 Claims, 1 Drawing Sheet

11
10
A
22
-27-
20
12
14
16
18
-28-
24
26
32
34
36
38
44
30
40
42
46

AUXILIARY PUMP MEANS OF AN ADVANCE ARRANGEMENT OF A HIGH PRESSURE PISTON PUMP

FIELD OF THE INVENTION

This invention relates to an advance arrangement for use in adjusting the timing of fuel delivery of a high pressure fuel pump.

BACKGROUND OF THE INVENTION

In a known high pressure fuel pump, a rotor is provided with one or more bores, pumping plungers being reciprocable within the bores. The outer end of each pumping plunger has a shoe and roller arrangement associated therewith, the rollers being engageable with the cam surface of a cam ring. As the rollers ride over cam lobes forming part of the cam surface during rotary motion of the rotor with respect to the cam ring, the plungers are pushed inwardly into the respective bores, pressurizing and displacing fuel from the bores to permit fuel to be supplied under pressure to the cylinders of an associated engine.

It will be appreciated that the timing of fuel delivery by the pump is dependent upon the position of the cam lobes, and hence upon the angular position of the cam ring. The timing of fuel delivery can therefore be advanced or retarded by moving the cam ring. One way of moving the cam ring is to provide the cam ring with an outwardly extending peg which is received within a recess or opening provided in an advance piston. The piston is slidable within a bore, and is spring biased towards one end of the bore. Fuel under pressure is supplied to the bore, the fuel pressure acting on a surface of the piston to apply a force to the piston acting against the spring. In such an arrangement, variations in the fuel pressure applied to the bore result in the advance piston occupying different axial positions, the engagement between the piston and the peg transmitting axial movement of the piston to the cam ring, adjusting the angular position of the cam ring.

The fuel supplied to the advance piston is conveniently drawn from a low pressure feed pump which is used to supply fuel to the high pressure pump. The output pressure of the feed pump is conveniently controlled so as to be related to engine speed, and in such an arrangement, the timing of fuel delivery by the high pressure pump is related to engine speed. It is known to provide a valve arrangement between the feed pump and the advance piston whereby the fuel pressure applied to the advance piston, and hence the timing of fuel delivery, can be controlled independently of engine speed.

It is advantageous to minimize the quantity of fuel drawn from the feed pump for purposes other than supplying the high pressure pump with fuel in order to reduce the maximum capacity of the feed pump.

BRIEF SUMMARY OF THE INVENTION

According to the present invention there is provided an advance arrangement for use with a high pressure pump which is arranged to be supplied with fuel by a feed pump, the advance arrangement comprising an advance piston slidable within a bore, the advance piston being cooperable with the cam arrangement of the high pressure pump to transmit axial movement of the advance piston to the cam arrangement to adjust the timing of fuel delivery by the high pressure pump, a face of the advance piston defining, with the bore, a control chamber, and pump means independent of the feed pump for supplying fluid to the control chamber.

The pump means conveniently comprises a reciprocating electromagnetically operated axial piston pump. The pump is preferably operated under the control of a control system whereby the speed of reciprocation of the pump is adjusted to control the fluid volume within the control chamber.

It will be appreciated that as the pump means is independent of the feed pump, the operation of the advance arrangement does not draw fuel from the feed pump, thus the maximum capacity of the feed pump can be reduced.

BRIEF DESCRIPTION OF THE DRAWING

The invention will be described, by way of example, with reference to the accompanying drawing (FIG. 1) which is a diagrammatic view of an advance arrangement in accordance with an embodiment of the invention.

DETAILED DESCRIPTION OF THE INVENTION

Figure 1:
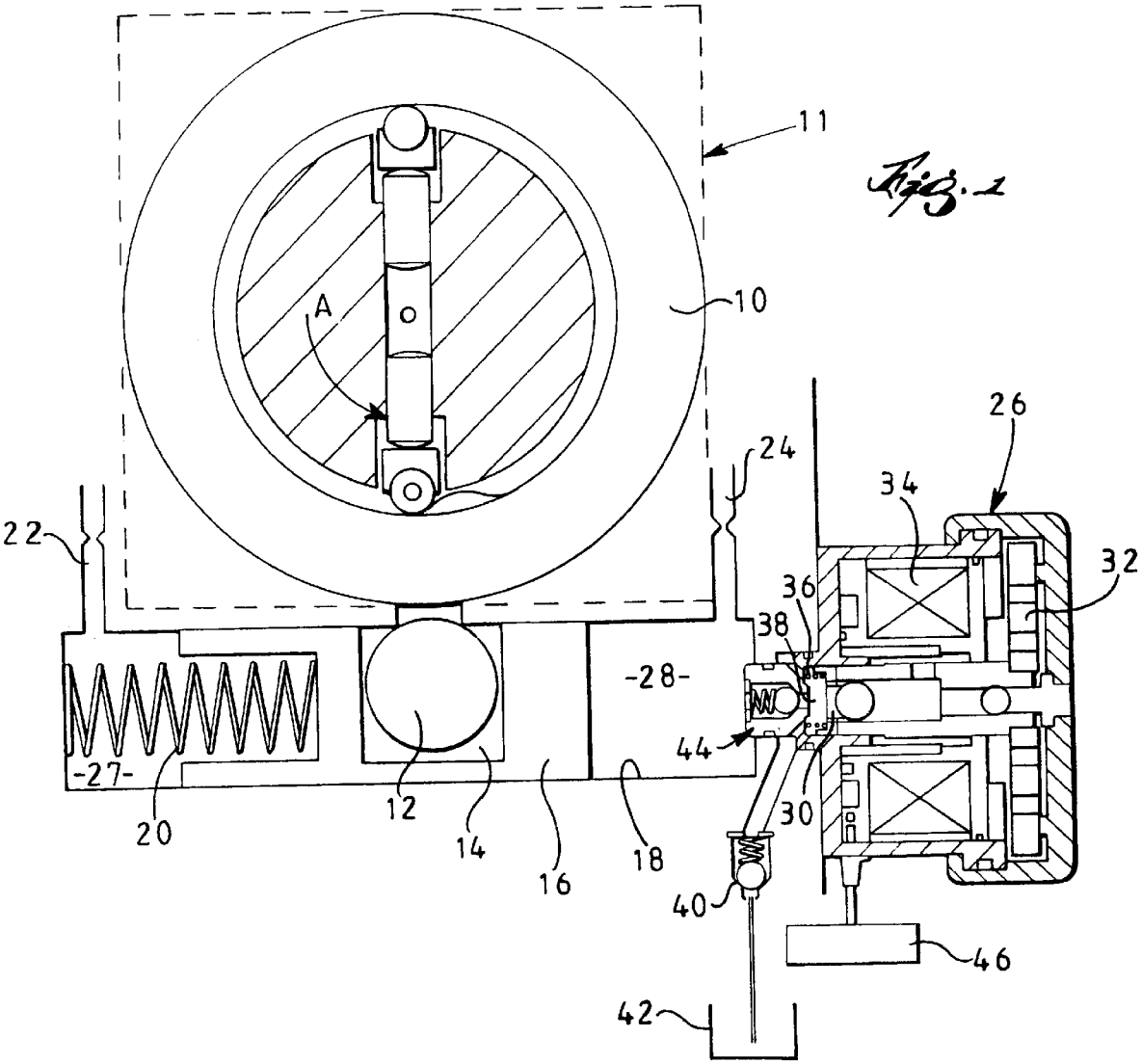

The advance arrangement illustrated in the accompanying drawing is intended for use with a high pressure fuel pump of the type comprising a distributor member rotatable within a sleeve, the distributor member including a plurality of radially extending bores within which pumping plungers are reciprocable. The outer end of each plunger engages the shoe of a shoe and roller arrangement, the roller of which is cooperable with the cam surface of an angularly adjustable cam ring 10. The cam ring 10 includes a plurality of inwardly extending cam lobes 10*a*, and as the rollers ride over the cam lobes 10*a*, it will be appreciated that the plungers are pushed inward into the bores, pressurizing fuel within the bores. Appropriate inlet and outlet ports are provided whereby fuel can be supplied at relatively low pressure to the bores from a feed pump, and whereby during inward movement of the pumping plungers, fuel can escape from the bores at high fuel pressure to be supplied to the cylinders of an associated engine, in turn. The timing of fuel delivery by the high pressure fuel pump can be adjusted by adjusting the angular position of the cam ring 10. Such angular movement of the cam ring 10 is achieved by means of an outwardly extending peg 12 provided on the cam ring 10 which is received within a recess 14 provided in an advance piston 16. The advance piston 16 is slidable within a bore 18 provided in a housing, the piston 16 being biased towards an end of the bore 18 by a spring 20. The piston 16 is a sufficiently good fit within the bore 18 that substantially no fluid is able to flow from one end of the piston 16 to the other end thereof. In order to permit movement of the piston 16 within the bore 18, it will be appreciated that the chambers 27, 28 defined between each end of the piston 16 and the bore 18 need to be vented, and appropriate vent passages 22, 24 are provided.

In order to adjust the axial position of the piston 16 within the bore 18, a fuel pump 26 is provided, the fuel pump being arranged to supply fuel to the chamber 28 defined between the end of the piston 16 remote from the spring 20, and the bore 18.

The fuel pump 26 comprises a piston member 30 slidable within a bore. The piston member 30 is coupled to an armature 32 which is reciprocable under the influence of the electromagnetic field generated by a coil 34. A return spring 36 engages the piston member 30, biasing the piston member 30 towards a position in which the armature 32 is spaced from the coil 34. The piston member 30 and bore together define a pumping chamber 38 which communicates through an inlet, spring biased non-return valve 40 with a supply of fuel at low pressure, and through an outlet, spring biased non-return valve 44 with the chamber 28.

In the position shown, the coil 34 is de-energized, and the piston member 30 has moved under the influence of the return spring 36 to space the armature 32 from the coil 34. In this position, the pumping chamber 38 is charged with fuel at relatively low pressure as a result of the movement of the piston member 30 drawing fuel through the non-return valve 40 from the fuel reservoir 42. Upon energizing the coil 34, the armature 32 is attracted towards the coil 34 resulting in movement of the piston member 30 against the action of the return spring 36. Such movement of the piston member 30 displaces the fuel within the pumping chamber 38, through the non-return valve 44 to the chamber 28. De-energization of the coil 34 results in the piston member 30 returning to the position illustrated under the action of the spring 36, further fuel being drawn through the non-return valve 40 to the pumping chamber 38. It will be appreciated that the inlet and outlet non-return valves 40, 44 substantially prevent fuel flow in the reverse direction.

It will be appreciated that the fuel volume within the chamber 28 is dependent upon the rate of fuel flow out of the chamber 28 through the restricted vent passage 24, and upon the frequency at which the coil of fuel pump 26 is energised which is controlled by a controller 46. An increase in the rate of operation of the fuel pump 26 results in an increase in the volume of fuel within the chamber 28. Such an increase in volume displaces the advance piston 16, which moves against the action of the spring 20 to compress the spring 20, the axial movement of the advance piston 16 resulting in angular movement of the cam ring 10 in a clockwise direction in the orientation illustrated as a result of the cooperation between the advance piston 16 and the peg 12. Assuming that the rotor of the high pressure fuel pump is arranged to rotate in the direction denoted by arrow A in the accompanying drawing, such movement of the advance piston 16 results in the timing of fuel delivery being advanced. If the rate of operation of the fuel pump 26 is reduced to a sufficient extent that fuel leaves the chamber 28 at a rate greater than the supply of fuel thereto by the fuel pump 26, the fuel volume within the chamber 28 is reduced resulting in movement of the advance piston 16 towards the right in the orientation illustrated. Such movement results in the cam ring 10 moving in an anticlockwise direction resulting in the timing of fuel delivery by the high pressure pump being retarded.

As described hereinbefore, the position of the piston 16 may be controlled by changing the rate of operation of the fuel pump 26, and this may be achieved by changing the frequency or mark-space ratio of the electrical supply to the pump 26 from the controller 46. Such frequencies could be mapped in an open-loop control system, or driven by feedback of the position of the piston 16, or other derived characteristic, which may be derived from a suitable sensor, in a closed loop system.

In use, upon the rollers of the shoe and roller arrangements engaging the cam lobes 10*a*, a large reaction force is applied to the cam ring, and hence to the advance piston 16. In order to reduce movement of the advance piston 16 as a result of the application of such a reaction force, it is desirable to minimise the quantity of fuel able to escape from the chamber 28 at the time over which the reaction force is applied. It is therefore desirable to select the dimensions of the vent passage 24 taking this factor into account. It is also desirable to ensure that the operation of the pump 26 does not result in the valve 44 being open as the reaction force is applied, and this can be achieved by controlling the operation of the pump 26 appropriately.

It will be appreciated that by providing the advance arrangement with a fuel pump which is totally separate from the feed pump used to supply the bores of the high pressure fuel pump with fuel, the load on the feed pump is reduced thus permitting a lower maximum capacity feed pump to be used. The use of a pump separate from the feed pump also permits the advance piston to be driven using a fluid other than fuel, if desired.

The invention is also applicable to a high pressure pump of the type comprising a pumping plunger which is rotatable within a bore, an end face of the plunger defining a cam surface which cooperates with a plurality of rollers located within an angularly adjustable cage. As the plunger rotates, the cooperation between the rollers and the cam surface causes the plunger to reciprocate within the bore. The timing of fuel delivery can be adjusted by changing the angular position of the cage in a manner similar to that described hereinbefore.

What is claimed is:

1. An advance arrangement for use with a high pressure pump which is supplied with fuel by a feed pump, the high pressure pump including a plunger bore within which at least one pumping plunger is reciprocable to pressurize fuel within the plunger bore, the advance arrangement comprising:

a body including a piston bore;

an advance piston positioned within said piston bore and engaged with a cam arrangement on the high pressure pump such that axial movement of said advance piston transmits rotary motion to the cam arrangement in order to adjust when fuel pressurization is initiated within the plunger bore; and a control pump connected directly to said piston bore on a side of said advance piston for independently controlling pressure within said piston bore thereby permitting use of a reduced capacity feed pump to supply fluid to the high pressure pump.

2. An advance arrangement as claimed in claim 1, wherein said control pump includes a reciprocating pump.

3. An advance arrangement as claimed in claim 2, wherein said reciprocating pump includes an electromagnetically operated axial piston pump.

4. An advance arrangement as claimed in claim 1, wherein said control pump supplies fuel to said piston bore using fuel that is drawn from the same source as the fuel supplied by the feed pump to the high pressure pump.

5. An advance arrangement as claimed in claim 1, wherein said control pump is positioned immediately adjacent to said piston bore.

6. A fuel system comprising:

a high pressure fuel pump including a cam arrangement and a plunger bore within which at least one pumping plunger is reciprocable to pressurize fuel within the plunger bore, a feed pump for supplying fuel to said high pressure fuel pump;

an advance arrangement including a body having a piston bore and an advance piston positioned within said piston bore, said advance piston being engaged with said cam arrangement on said high pressure fuel pump such that axial movement of said advance piston transmits rotary motion to said cam arrangement in order to adjust when fuel pressurization is initiated within the plunger bore; and a control pump connected directly to said piston bore on a side of said advance piston for independently controlling pressure within said piston bore thereby permitting a reduction in the capacity of said feed pump.

* * * * *